US005819923A

United States Patent [19]

Spring et al.

[11] Patent Number: 5,819,923

[45] Date of Patent: Oct. 13, 1998

[54] APPARATUS FOR OPENING A CONTAINER AND FOR DISPENSING A SUBSTANCE IN A LIQUID BEVERAGE

[75] Inventors: Robert E. Spring, New York, N.Y.; Scott Jones, Essex Falls, N.J.

[73] Assignee: Canning Concepts, Inc., Locust Valley, N.Y.

[21] Appl. No.: 603,980

[22] Filed: Feb. 20, 1996

[51] Int. Cl.[6] ..... B65D 25/08

[52] U.S. Cl. ..... 206/222; 220/258

[58] Field of Search ..... 206/222, 568, 206/219, 217; 220/258, 267

[56] References Cited

U.S. PATENT DOCUMENTS

| | | | |
|---|---|---|---|
| 2,417,592 | 3/1947 | Dwyer . | |
| 2,752,036 | 6/1956 | Parkhurst . | |
| 2,821,326 | 1/1958 | Fried | 220/258 |
| 3,134,577 | 5/1964 | Bollmeier . | |
| 3,371,818 | 3/1968 | Bozek | 220/267 |
| 3,970,211 | 7/1976 | LaCross | 220/267 |
| 4,039,100 | 8/1977 | Wells | 220/267 |
| 4,059,201 | 11/1977 | Foster | 220/258 |
| 4,148,409 | 4/1979 | Zundel | 220/267 |
| 4,221,291 | 9/1980 | Hunt . | |
| 4,264,007 | 4/1981 | Hunt . | |
| 4,333,581 | 6/1982 | Flansburg . | |
| 4,598,837 | 7/1986 | Kreiseder et al. | 220/258 |
| 4,609,123 | 9/1986 | Poncy | 220/258 |
| 4,821,912 | 4/1989 | Wells | 220/267 |
| 4,995,218 | 2/1991 | Byrne . | |
| 5,255,812 | 10/1993 | Hsu . | |
| 5,290,574 | 3/1994 | Jamieson et al. . | |

*Primary Examiner*—Paul T. Sewell
*Assistant Examiner*—Nhan T. Lam
*Attorney, Agent, or Firm*—Robert D. Katz; Robert T. Maldonado

[57] ABSTRACT

An apparatus for opening a container and for dispensing a substance in a liquid beverage contained in a container includes a flat portion defining a wedge-shaped cut-out, side portions that extend downwardly from the flat portion, and an opening lever attached to the flat portion. The opening lever may include a receptacle containing the substance to be dispensed, a burstable material covering one end of the opening lever, and a plunger attached at an opposite end of the opening lever. The plunger is pushed to compress the substance and break the burstable material to dispense the substance. Otherwise, the opening lever contains no receptacle and is used simply to open the pour panel formed in the top of the container or a tearable receptacle is attached to an underside of the flat portion at a position corresponding to the cut-out so that the opening lever tears open the receptacle and releases the substance contained therein. The opening lever has a pointed end and may extend past the edge of the container, or the opening lever may be formed so as to be displaced a predetermined distance from the surface of the cap at a lifting end to form a gap to accommodate a fingertip. The opening lever may be slidingly attached to the container cap or may be directly attached to the top of the container itself.

17 Claims, 7 Drawing Sheets

APPARATUS FOR OPENING A CONTAINER AND FOR DISPENSING A SUBSTANCE IN A LIQUID BEVERAGE

FIELD OF THE INVENTION

The present invention relates generally to beverage containers and, more specifically, to devices that open beverage containers and dispense a substance, such as medication, into a beverage or other liquid in the container.

BACKGROUND OF THE INVENTION

Various devices for dispensing a substance into a beverage container have been proposed. Some of these devices include a removable top containing the substance that is to be dispensed. The top snaps onto an upwardly open beverage container, such as a cup. Some mechanism, such as a lever, or an operation, such as bending up the top, is used to release the substance into the container, then the top is removed in order to drink the beverage. For example, see U.S. Pat. Nos. 3,305,368 (Bourelle), 3,326,363 (Bennett), 3,779,372 (de Lloret), 4,634,003 (Ueda), 4,785,931 (Weir), and 5,052,553 (DeSanctis). These devices, however, are not usable with existing cans that include a top.

SUMMARY OF THE INVENTION

It is therefore an important or principal object of the present invention to provide an apparatus that facilitates the opening of a beverage container, such as a soft drink can, and also facilitates the dispensing of a substance in a liquid beverage contained in the beverage container and which is adaptable to existing cans.

The foregoing object is achieved and the disadvantages of the devices discussed above are overcome by providing a container cap for a beverage container comprising a generally disc-shaped flat portion defining a cut-out, side portions extending downward from a peripheral edge thereof, and an opening lever attached to the flat portion proximate the cut-out. The container cap engages the top of the beverage container so that an end of the opening lever opposes a pour panel in the top of the container. This may be accomplished by providing the container cap with inward projections extending from an inner surface of the side portions of the cap which mate with the sidewall of the container. At least one projection is attached to a releasing lever that extends beyond a peripheral edge of the cap to facilitate removal of the cap. Alternatively, the cap may be attached by frictional engagement, screw thread engagement on the cap, or similar types of joining a cap to a base.

The opening lever used in the present invention comprises a receptacle for containing a substance to be dispensed in a beverage contained in the beverage container and an opening end of the opening lever including a hole covered by a burstable material. Further, a hole is formed in a lifting end of the opening lever and a plunger is fitted in the hole. The opening lever is designed to dispense the contained substance to avoid splashing upon relesase. The burstable material may be covered with a protective wrap, that is easily detachable for removal prior to dispensing, to ensure cleanliness of the tip and to ensure that no tampering has occurred. The lever can extend in length beyond the edge of the cap. Further, the opening lever may be formed so as to define a gap between the underside of its lifting end and the upper surface of the flat portion of the container cap.

In another embodiment, the container cap comprises a cover including a flat portion and a depending circumferential portion. The flat portion defines a cut-out that can align with the pour panel formed in the top of a conventional soft drink can. The depending circumferential portion has inward projections for engaging the top portion of a container such as a soft drink or juice can. At least one of the inward projections is attached to a releasing lever to facilitate removal of the cap. The container cap has, on the underside of the circular flat portion, a tearable or burstable container, such as foil, attached with an adhesive at a position that corresponds with the cut-out. The tearable or burstable container is supplied with medication or another additive normally suspended in a suitable liquid medium which will be dispensed in the liquid in the container. An opening lever attached to the top of the container cap acts as a dispenser by breaking through the burstable container when lifted. The opening lever may also act as a container opener by pushing open the pour panel of the container when the opening lever is further lifted and extends further downward through the cut-out of the flat portion. The opening lever includes a generally triangular shaped tip that facilitates dispensing the contained substance and can extend in length beyond the edge of the cap.

According to an operation of the present invention, the container cap is mounted on the top of the beverage container so that when the lifting end of the opening lever is lifted, the opening end of the opening lever moves downward to break open the pour panel in the top of the container, and the plunger is pushed to compress the substance contained in the receptacle to break the burstable material to dispense the substance in the beverage. The lever and the mechanism that attaches it to the container cap may be designed so as to provide a limited range of movement so that after opening the container, the lever may be translated in a direction away from the container pour panel to facilitate drinking of the beverage contained in the container.

As another embodiment of the present invention, the opening lever could be manufactured as an integral part of the can top when such top is produced, and not as part of a separate container cap that is attached to the container.

BRIEF DESCRIPTION OF THE DRAWINGS

Further objects, features and advantages of the invention will become apparent upon review of the following detailed description of the preferred embodiments, taken in conjunction with the following drawings, in which.

DETAILED DESCRIPTION OF PREFERRED EMBODIMENTS

The present invention relates to a device for opening the pour panel of a beverage container, which device may also incorporate a receptacle that contains a substance to be dispensed in a liquid beverage contained in the container. The substance can be medication, including analgesics, or a flavoring agent, a sweetening agent or an alcoholic beverage, for example.

Figure 1:
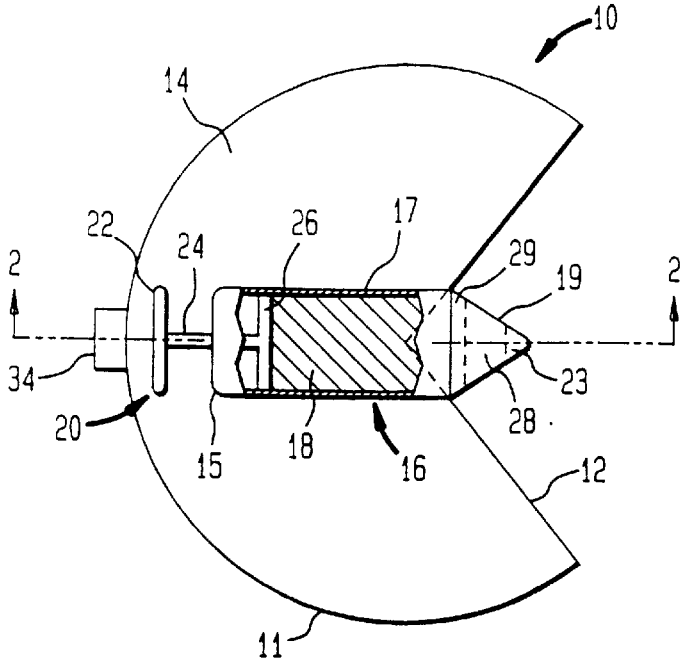
FIG. 1 is a top view partially broken away of a container cap according to the present invention.
Figure 2:
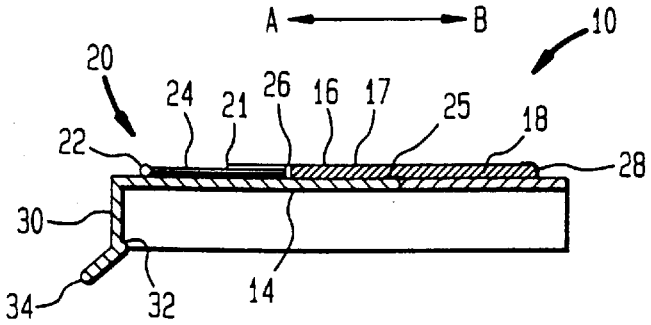
FIG. 2 is a sectional view, taken in section along line 2—2 in FIG. 1, of a container cap including an ingredient dispenser according to a first embodiment of the present invention.

The snap-on container cap of the present invention preferably sits on and may be used with a conventional beverage container such as a soft drink can. As shown in FIG. 1, the snap-on cap 10 has a circular disc shape, and includes a cut-out 12 formed in a flat portion 14 thereof. The cut-out 12 is of a wedge shape to prevent interference between the cap 10 and the pour panel 50 of the container (shown in FIG. 4). Side portions 30 extend downward from the peripheral edge 11 of the flat portion 14, as shown in FIG. 2, and include one or more projections 32 projecting inwardly. A releasing lever 34 that extends outwardly from the peripheral edge 11 of the cap 10 is attached to a projection 32. Both the releasing lever 34 and the projections 32 are formed of a resilient material, such as an elastomeric or thermoplastic material.

An opening lever 16 is attached at an underside thereof to an upwardly bendable flap 25 of the flat portion 14 at or near a midpoint of the opening lever 16 proximate the cut-out 12. The flap 25 is part of the flat portion 14 and is formed of a bendable material. The flap 25 may be pivotal with respect to the flat portion 14. As shown in FIG. 1, the opening lever 16 includes a lifting end 15 and a pointed opening end 19 opposite the lifting end 15 and may include a receptacle 17 for containing a substance 18 to be dispensed. A plunger 20 fits through a hole 21 formed in the lifting end 15 and includes a handle 22 attached to a shaft 24 attached to a pusher 26 for pushing the substance 18 to be dispensed out of the receptacle 17. The shaft 24 is formed of a non-breakable material so that the plunger 20 will not fracture if a user lifts the opening lever 16 by lifting the plunger 20. The plunger 20 slides into and out of the opening lever 16 in the A-B direction indicated in FIGS. 2 and 4. The opening end 19 of the opening lever 16 includes a hole 23 covered by a burstable material 28, such as foil, that is attached with an adhesive. The burstable material 28 itself may be covered by a protective wrap 29, such as cellophane, to keep it clean and free from contaminants. The wrap 29 is removed before the plunger 20 is activated.

Figure 6:
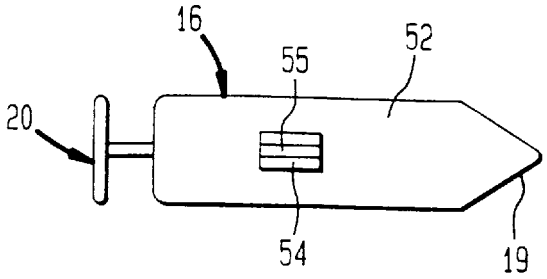
FIG. 6 is a bottom view of an opening lever according to a second embodiment of the present invention.
Figure 7:
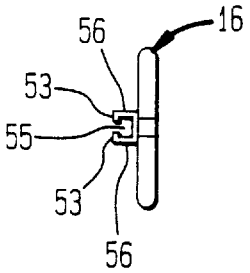
FIG. 7 is a side view of the opening lever shown in FIG. 6.
Figure 8:
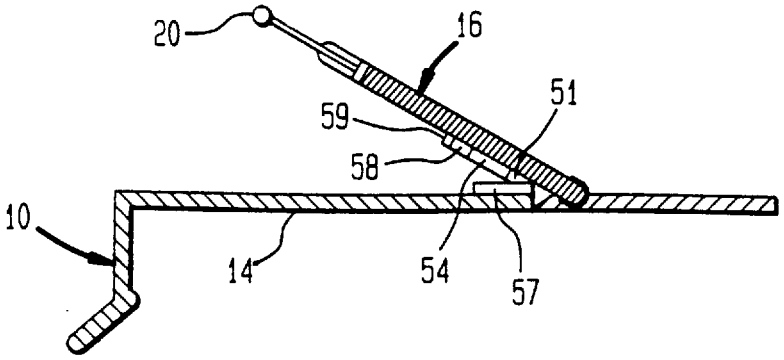
FIG. 8 is a sectional side view taken in section along line 2—2 in FIG. 1, incorporating the opening lever of FIG. 6, according to a second embodiment of the present invention.
Figure 9:
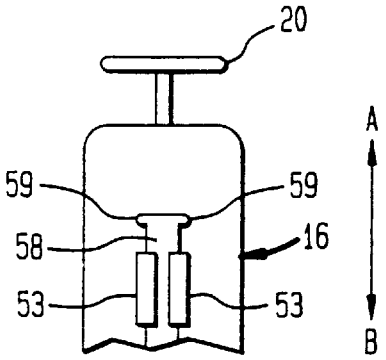
FIG. 9 is a partial bottom view of the opening lever attached to the container cap as shown in FIG. 8.

According to a second embodiment, the opening lever 16 may be attached to the flat portion 14 of the container cap 10 so that it is slidable in the A-B direction of FIG. 1. For the slidable attachment, a guide 54 is provided on the underside 52 of the opening lever 16, as shown in FIG. 6. The guide 54 has a C-shaped cross-section, as shown in FIG. 7, and includes a pair of opposing upwardly oriented side rails 56, 56 that define a groove 55. In FIG. 8, the opening lever 16 is shown attached to the container cap 10 according to the embodiment of the present invention. As illustrated, the container cap 10 includes a bendable flap 51 comprised of a base section 57 that may be pivotally attached to the flat portion 14 of the container cap 10 and an upwardly bendable section 58. The width of the bendable section 58 is less than the width of the groove 55, as shown in FIG. 9, so that the bendable section 58 fits in the groove 55 and is held therein by the lips 53, 53 of the side rails 56, 56. The end of the bendable section 58 includes extensions 59, 59 projecting from either side to ensure that the opening lever 16 remains attached to the container cap 10 and does not slide off. The length of the bendable section 58 of the flap 51 is greater than the length of the guide 54 so that the opening lever 16 is translatable with respect to the container cap 10 in the A-B direction. This arrangement enables a user to move the opening end 19 of the opening lever 16 away from the pour panel 50 of the container 40 after the substance 18 has been dispensed so that the beverage 48 can be more easily drunk without interference from the opening lever 16.

Figure 3A:
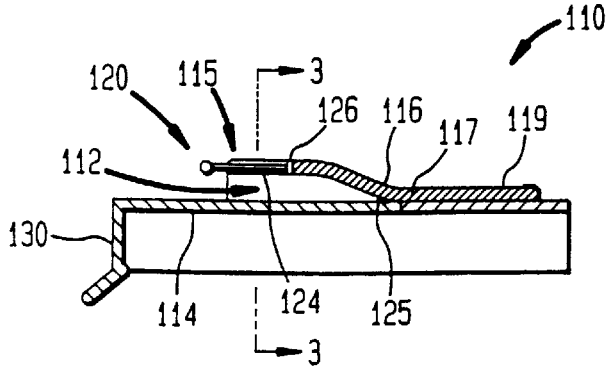
FIG. 3A is a sectional view, taken in section along line 2—2 in FIG. 1, of a container cap including an opening lever with a raised opening end.
Figure 3B:
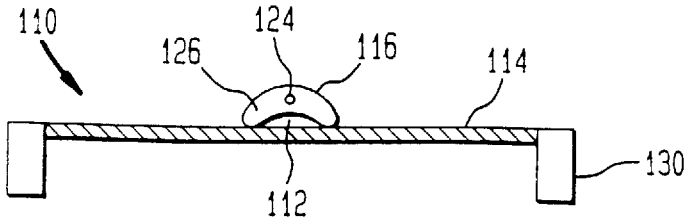
FIG. 3B is a sectional view, taken in section along line 3—3 in FIG. 3A, of the container cap shown in FIG. 3A.

In order to discourage a user from lifting the plunger 120, the lifting end 115 of the opening lever 116 can be displaced from the upper surface of the flat portion 114 of the snap-on cap 110, as shown in FIGS. 3A and 3B. According to this modification of the first and second embodiments, the upper surface of the opening lever 116 slopes upwardly from an opening end 119 to the lifting end 115 so that a gap 112 is formed between the underside of the lever 116 and the upper surface of the flat portion 114. This configuration, which resembles an inverted U-shape in cross-section as shown in in FIG. 3B, enables a user to insert a fingertip in the gap 112 to facilitate a lifting of the opening lever 116. In this case, the shaft 124 of the plunger 120 is sufficiently bendable so as to conform to the changing shape of the receptacle 117 as the plunger 120 is pushed in.

Figure 4:
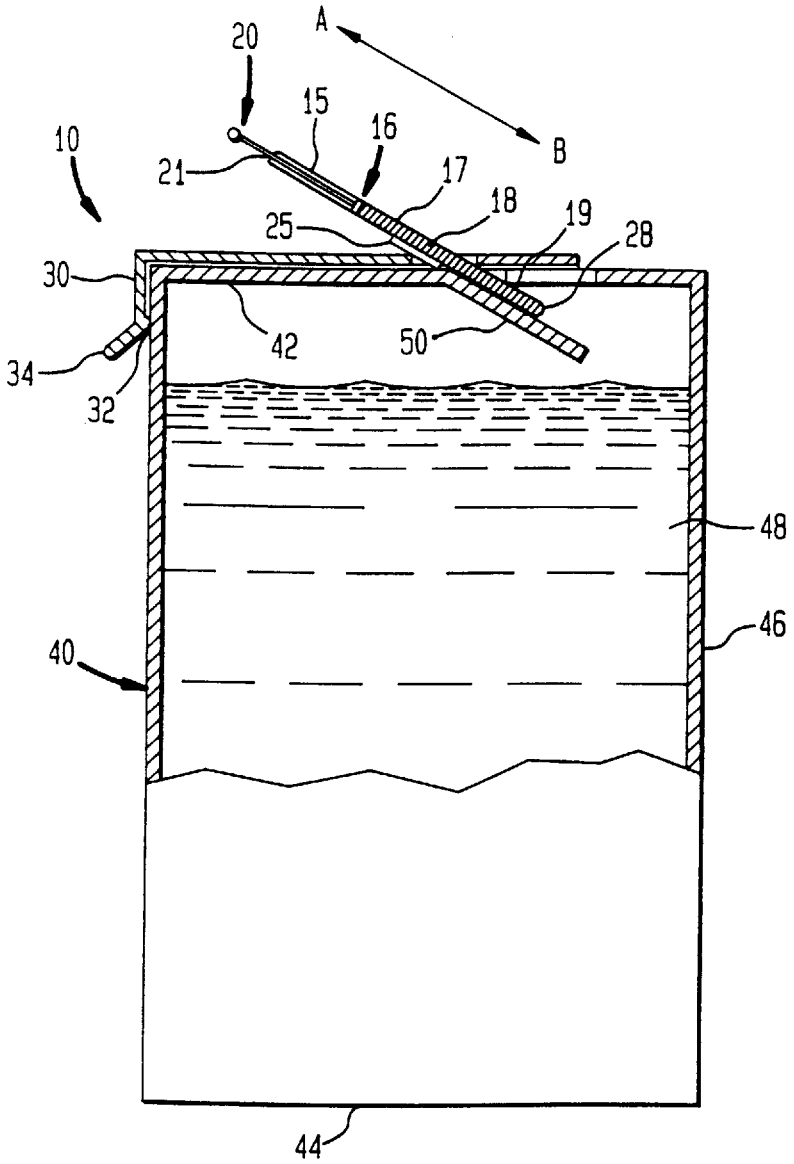
FIG. 4 is the sectional side view of FIG. 2 displaying the container cap attached to a container shown in partial sectional view and in an opened state.

An operation of the present invention will now be described with reference to FIG. 4. The snap-on cap 10 is snapped onto a conventional beverage container 40, such as a carbonated or non-carbonated soft drink, fruit juice, mixer, sports drink, water or other appropriate or applicable liquid container, with an easy-to-open retainer tab on its top end. The beverage container 40 is formed of a top 42, a bottom 44, and a sidewall 46. The bottom 44 may be formed as an integral part of the sidewall 46 or it may be attached thereto separately. The container 40 may be cylindrical in shape and contains a beverage 48 to be consumed by a user. The snap-on cap 10 is attached to the container 40, and the projections 32 of the side portions 30 abut and frictionally grip the sidewall 46 of the container 40. The top 42 of the container 40 has a pour panel 50 that is openable and non-resealable. The pour panel 50 is opened by lifting the lifting end 15 of the opening lever 16, which causes the opening end 19 of the opening lever 16 to move downward to break open the pour panel 50 on the container 40. To release the substance 18 from the opening lever 16, the plunger 20 is pushed in the B direction of FIG. 4, thereby compressing the substance 18 and causing the burstable material 28 on the opening end 19 of the opening lever 16 to burst open and empty its contents through the hole 23 into the container 40. If the opening lever 16 is provided with a protectible wrap 29, the wrap 29 is removed before the plunger 20 is activated. The mixed beverage can then be consumed from the container without having to remove the snap-on cap 10. Additionally, according to the second embodiment described above, the opening lever 16 may be slid away from the area of the pour panel 50 so as not to interfere with consumption or pouring of the beverage from the container 40. Alternatively, the snap-on 10 can be easily removed by lifting the releasing lever 34, thereby causing the projections 32 to elastically release from engagement with the sidewall 46 of the beverage container 40. The present invention is particularly convenient, therefore, for administering medication to those too young or otherwise unable to swallow or chew tablets.

Figure 5:
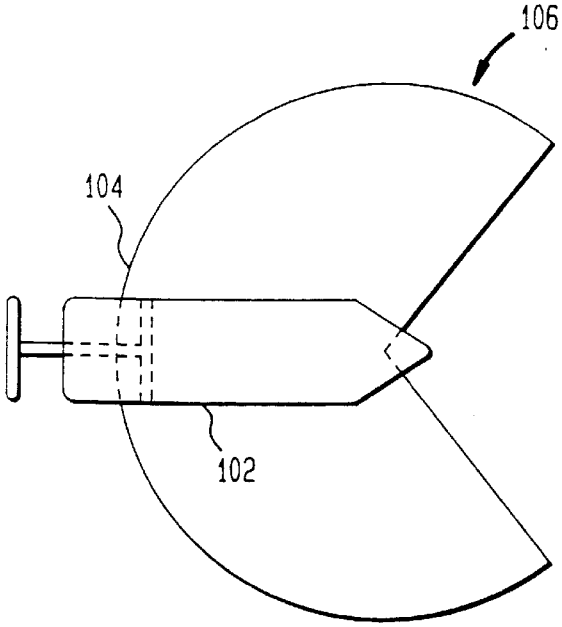
FIG. 5 is a top view of a modified embodiment of the container cap of the present invention including an extended opening lever.

As shown in FIGS. 1–4, the length of the opening lever 16 may be such that the opening lever 16 does not extend beyond the peripheral edge 11 of the cap 10. Alternatively, as shown in FIG. 5, the opening lever 102 may extend beyond the peripheral edge 104 of the container cap 106 to facilitate the lifting of the opening lever 102. In such a case, it becomes unnecessary for the lifting end to be formed in an inverted U-shape so as to be displaced from the upper surface of the flat portion 114 of the container cap 110, as shown in FIGS. 3A and 3B.

Figure 10:
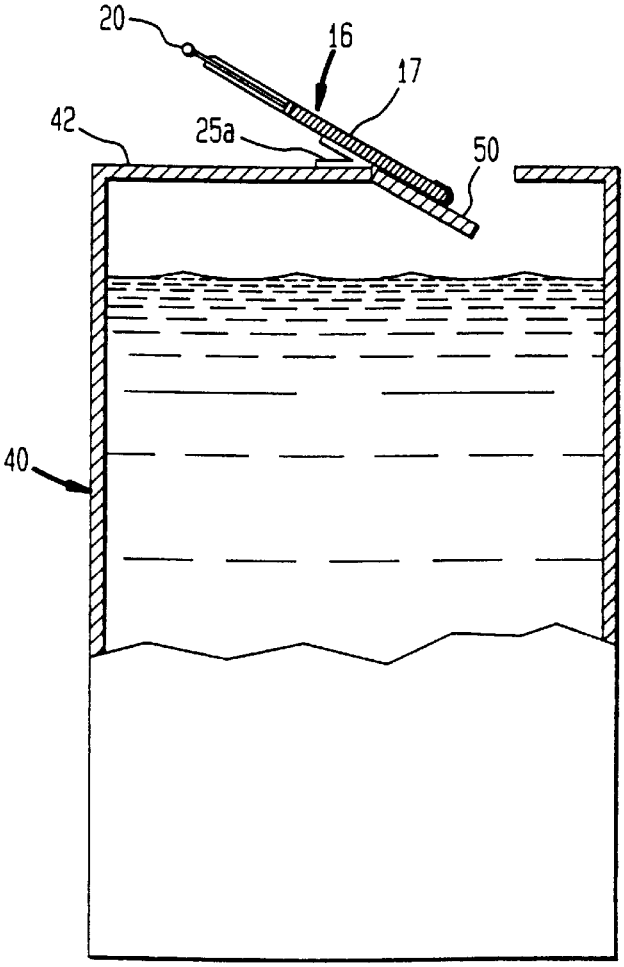
FIG. 10 is a side view of a third embodiment of the present invention with the lever shown in sectional view and the container shown in partial sectional view.

As an alternative third embodiment, shown in FIG. 10, the opening lever 16 including the receptacle 17 can be attached directly to the top 42 of the container 40 without the need for a detachable container cap 10. According to such a construction, the bendable flap 25*a* is attached directly to the top 42 of the container 40 and to the underside of the opening lever 16. Thus, the lever 16 can be readily adapted to existing canning techniques.

According to a fourth embodiment of the present invention (shown in FIG. 11), a container cap 60 includes a disc-shaped flat portion 64 with a wedge-shaped cut-out 66 and an opening lever 62 attached to the flat portion 64 proximate the cut-out 66. The opening lever 62 is secured by an upwardly bendable flap 25 that is attached to the flat portion 64 and to the underside 68 of the opening lever 62. The opening lever 62 does not include a receptacle and, thus, does not contain a substance to be dispensed. Rather, lifting the opening lever 62 solely opens the pour panel 50 of the container 40 shown in FIG. 4. As shown in FIGS. 12 and 13, the opening lever 62 is displaced from the upper surface of the flat portion 64 at an opening end 65 thereof to enable one to easily insert a fingertip in the gap 63 formed beneath the opening lever 62 to open a container without damaging one's fingernails. The opening end 65 has an inverted U-shaped cross-section, as shown in FIG. 13, with the gap 63 being formed between an underside of the opening lever 62 and the upper surface of the flat portion 64.

Figure 11:
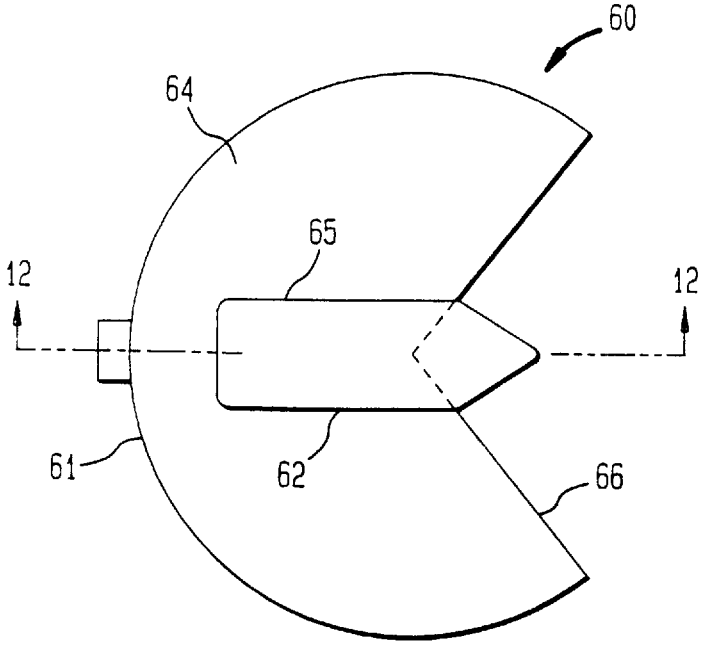
FIG. 11 is a top view of a container cap according to a fourth embodiment of the present invention.
Figure 12:
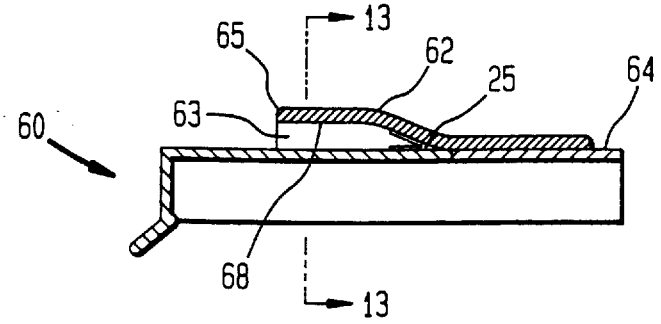
FIG. 12 is a sectional view, taken in section along line 12—12 in FIG. 11, of the fourth embodiment of the present invention.
Figure 13:
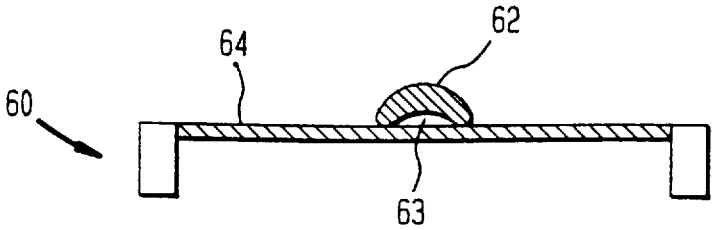
FIG. 13 is a sectional view, taken in section along line 13—13 in FIG. 12, of the fourth embodiment of the present invention.
Figure 14:
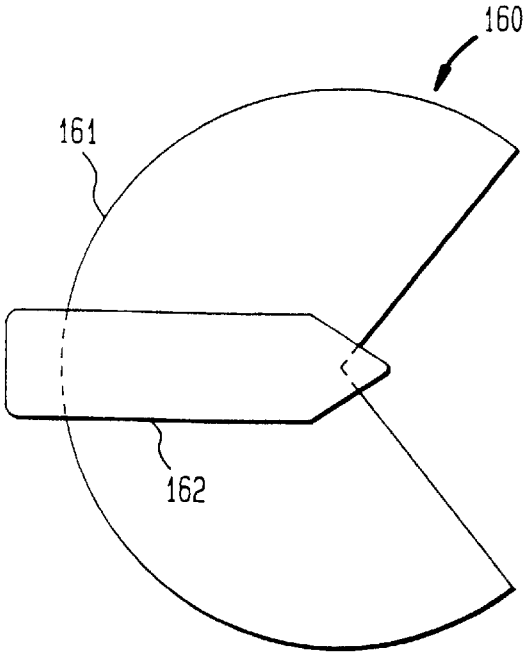
FIG. 14 is a top view of the container cap according to the fourth embodiment including an extended opening lever.

As shown in FIGS. 11, 12 and 13, the length of the opening lever 62 may be such that the opening lever 62 does not extend beyond the peripheral edge 61 of the cap 60. Alternatively, as shown in FIG. 14, the opening lever 162 may extend beyond the peripheral edge 161 of the container cap 160. In such a case, it becomes unnecessary for the lifting end to be formed in an inverted U-shape so as to be displaced from the upper surface of the flat portion of the container cap.

Figure 15:
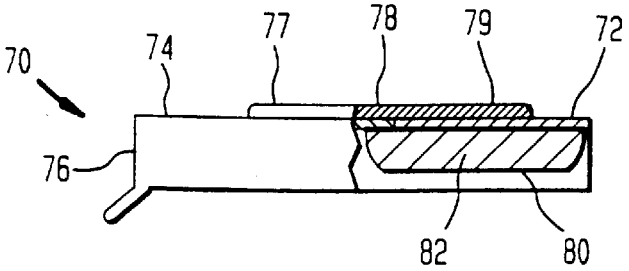
FIG. 15 is an elevational view partially in section and partially broken away of a fifth embodiment of the present invention.
Figure 16:
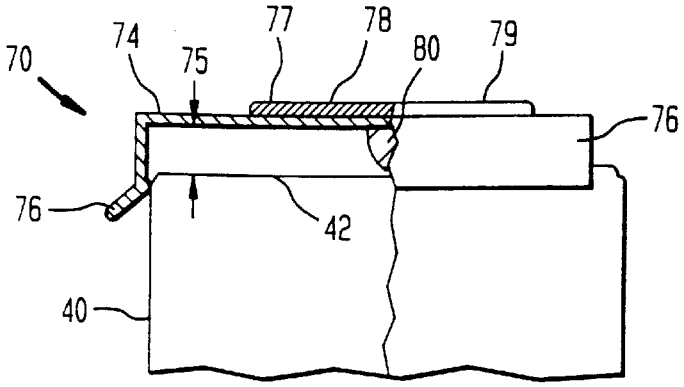
FIG. 16 is an elevational view partially in section and partially broken away of the fifth embodiment of the present invention as shown in FIG. 15 attached to a container.
Figure 17:
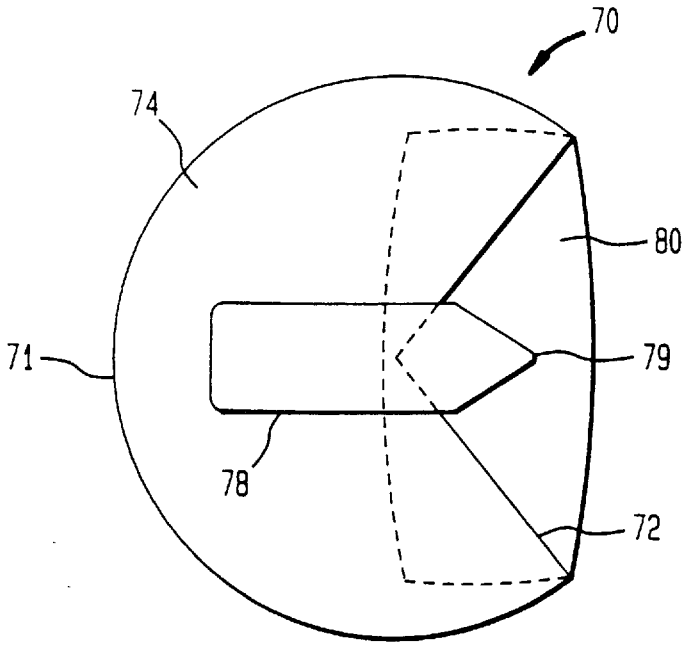
FIG. 17 is a top view of the fifth embodiment of the present invention.

A fifth embodiment of the present invention, illustrated in FIGS. 15, 16 and 17, is a container cap 70 for use in conjunction or combination with a conventional beverage container such as a soft drink can 40, wherein the receptacle is not defined by the lever but rather is attached to the underside of the cap 70. Referring to FIG. 17, the snap-on cap 70 has a circular disc shape, and includes a wedge-shaped cut-out 72 formed in a flat portion 74 thereof. Side portions 76 extend downward from the peripheral edge 71 of the flat portion 74, as shown in FIG. 15. An opening lever 78 is attached to the flat portion 74 proximate the cut-out 72. The opening lever 78 includes a lifting end 77 and a pointed opening end 79 opposite the lifting end 77. Similar to previous embodiments, although not shown, the lifting end 77 may extend beyond the peripheral edge 71 of the container cap 70. Likewise, similar to previous embodiments, although not shown, the lifting end 77 may be formed in an inverted U-shaped so as to be displaced from the upper surface of the flat portion 74 to form a gap to facilitate lifting of the opening lever without breaking one's fingernails (as shown in FIGS. 12 and 13).

A receptacle 80 for containing a substance 82 to be dispensed is attached to an underside of the flat portion 74 at a position corresponding to the cut-out 72 and opposing the opening end 79 of the opening lever 78. The receptacle 80 is formed of a tearable or burstable material, such as foil, a plastic sheet or a combination thereof. Unlike the previous embodiments, however, an underside of the flat portion 74 is spaced apart from the top 42 of the container 40 so as to define a gap 75 that accommodates the receptacle 80, as shown in FIG. 16. When the lifting end 77 of the opening lever 78 is lifted, the opening end 79 tears through the receptacle 80, thereby releasing the substance 82 into a beverage contained in the container. The opening lever 78 can simultaneously open the receptacle 80 and the pour panel 50 of the container 40, or the pour panel 50 of the container 40 can be opened by another means prior to attaching the container cap 70 thereto.

Having described specific preferred embodiments of the present invention with reference to the accompanying drawings, it is to be understood that the invention is not limited to those precise embodiments, and that various changes and modifications may be effected therein by one skilled in the art without departing from the spirit or the scope of the present invention as defined in the appended claims.

What is claimed is:

1. In combination with a container having a top and a non-resealable opening pour panel included in the top, a container cap comprising:

a flat portion extending partially around an edge of the container so as to define a container cap having a cut-out;

side portions extending downward from the flat portion of the container cap; and an opening lever attached to the container cap, the opening lever including a first end and a second end, the second end extending partially across the cut-out, wherein the opening lever is attached to the flat portion of the container cap at a point between the first end and the second end proximate the cut-out, and wherein the container cap is removably attached to the container.

2. A container cap according to claim 1, wherein the cut-out is wedge-shaped.

3. A container cap according to claim 1, further comprising projections projecting inwardly from an inner surface of the side portions, said projections for gripping the container.

4. A container cap according to claim 3, further comprising a releasing lever extending outward from the projections at an acute angle relative to a side of the container.

5. A container cap according to claim 4, wherein the side portions, the projections, and the releasing lever are formed of an elastomeric material.

6. A container cap according to claim 1, wherein the container cap is mounted on the top of the container so that the second end of the opening lever opposes the non-resealable opening pour panel on the top of the container.

7. A container cap according to claim 6, wherein downward movement of the second end of the opening lever breaks open the pour panel in the top of the container.

8. A container cap according to claim 1, wherein the second end of the opening lever is pointed.

9. A container cap according to claim 1, wherein the opening lever defines a receptacle for containing a substance to be dispensed in a beverage contained in the container.

10. A container cap according to claim 1, wherein the flat portion, the side portions, and the opening lever are formed of a plastic material.

11. A container cap according to claim 1, wherein the first end of the opening lever extends beyond the edge of the container.

12. A container cap according to claim 1, wherein the first end of the opening lever is formed so as to be displaced a predetermined distance from the flat portion of the container cap to form a gap between the opening lever and the flat portion.

13. In combination with a container having a top and a non-resealable opening pour panel included in the top, a container cap comprising:

a flat portion extending partially around an edge of the container so as to define a container cap having a cut-out;

side portions extending downward from the flat portion of the container cap; and an opening lever attached to the container cap, the opening lever defining a receptacle for containing a substance to be dispensed in a beverage contained in the container and including a first end and a second end, the second end extending partially across the cut-out and including an opening covered with a burstable material, wherein the opening lever is attached to the flat portion of the container cap at a point between the first end and the second end proximate the cut-out, and wherein the container cap is removably attached to the container.

14. A container cap according to claim 13, wherein the burstable material is covered with a removable protective wrap.

15. A container cap according to claim 13, wherein the opening lever further comprises a plunger slidably fitted in the opening lever.

16. A container cap according to claim 15, wherein the plunger is formed of a flexible material.

17. A container cap according to claim 15, wherein the container cap is mounted on the top of the container so that when the first end of the opening lever is lifted, the second end of the opening lever moves downward, and the plunger is pushed to compress the substance contained in the receptacle to break the burstable material to dispense the substance in the beverage.

* * * * *